US007913607B2

(12) United States Patent
Prytz et al.

(10) Patent No.: US 7,913,607 B2
(45) Date of Patent: Mar. 29, 2011

(54) IM-LOCK FOR WEAPONS HAVING PRELOADED PROJECTILES

(75) Inventors: Alf Prytz, Karlskoga (SE); Hans-Göran Ohlsson, Karlskoga (SE)

(73) Assignee: SAAB AB, Linköping (SE)

( * ) Notice: Subject to any disclaimer, the term of this patent is extended or adjusted under 35 U.S.C. 154(b) by 642 days.

(21) Appl. No.: 11/653,379

(22) Filed: Jan. 16, 2007

(65) Prior Publication Data

US 2010/0251881 A1 Oct. 7, 2010

(30) Foreign Application Priority Data

Jan. 13, 2006 (EP) ..... 06100337

(51) Int. Cl.
*F41A 21/00* (2006.01)

(52) U.S. Cl. ..... 89/14.05; 89/14.7; 89/16; 89/1.812

(58) Field of Classification Search ..... 89/14.05–14.7; 206/3

See application file for complete search history.

(56) References Cited

U.S. PATENT DOCUMENTS

| | | | | |
|---|---|---|---|---|
| 3,721,155 | A | 3/1973 | Stauff et al. | |
| 3,914,996 | A * | 10/1975 | Davis et al. | 73/167 |
| 4,199,093 | A * | 4/1980 | Combette et al. | 227/9 |
| 5,035,182 | A * | 7/1991 | Purcell et al. | 102/481 |
| 6,019,025 | A * | 2/2000 | St. Amand | 89/1.817 |
| 6,321,656 | B1 * | 11/2001 | Johnson | 102/377 |
| 6,615,702 | B1 * | 9/2003 | Julien | 89/16 |
| 6,843,014 | B1 * | 1/2005 | Aponte et al. | 42/70.06 |
| 7,549,375 | B2 * | 6/2009 | Cook et al. | 102/377 |
| 2004/0244358 | A1 * | 12/2004 | Prytz | 60/223 |
| 2008/0018522 | A1 * | 1/2008 | Redano | 342/62 |
| 2008/0307950 | A1 * | 12/2008 | Shah et al. | 89/1.8 |

FOREIGN PATENT DOCUMENTS

GB 710250 A 6/1954

OTHER PUBLICATIONS

European Search Report issued in priority application, May 22, 2006.

* cited by examiner

*Primary Examiner* — Troy Chambers
*Assistant Examiner* — Samir Abdosh
(74) *Attorney, Agent, or Firm* — Venable LLP; Eric J. Franklin

(57) ABSTRACT

A weapon having a barrel or launch tube and a projectile preloaded therein. An element prevents accidental firing of the projectile if the weapon becomes overheated.

12 Claims, 1 Drawing Sheet

IM-LOCK FOR WEAPONS HAVING PRELOADED PROJECTILES

CROSS-REFERENCE TO RELATED APPLICATIONS

This application claims priority to European patent application 06100337.2 filed 13 Jan. 2006.

TECHNICAL FIELD

The present invention relates to weapons having a barrel or launch tube and a projectile preloaded therein.

BACKGROUND OF THE INVENTION

History has proven that weapons are not only dangerous to the enemy but also the own troops due to accidental firing of weapons or of ammunition and missiles. Such accidental firing can be caused of collisions between weapon loaded vehicles or air planes, impact forces from projectiles hitting the weapon, etc. For this reason, modern weapons, ammunition and missiles should be designed to withstand certain accidental events without appreciable risk for personnel present in the area of accident. Certain standard tests have been set for testing weapons, ammunition and missiles to determine if these fulfil safety criteria in this respect. Examples of such tests are "Bullet impact test", "Fragment impact test", "Fast Cook-off Test" and "Slow Cook-off Test". If those tests show that a weapon system tested acts within acceptable limits, such a system is classified as an Insensitive Munition (IM) weapon system. It has been estimated that if the weapon systems on four aircraft carrier, on which accidents occurred in 1966, 1967, 1969 and 1981, respectively, had been IM weapon systems the loss of personnel had been reduced from 220 to 72 and the number of injured had been reduced from 709 to 161. It is thus very important that modern weapon systems are constructed also with regard to IM requirements.

The objective of the present invention is to solve the problem of making a weapon having a barrel or launch tube and a projectile preloaded therein capable of being subjected to overheat in case of a fire accident, which means that said weapon should pass the "Fast Cook-off Test" and "Slow Cook-off Test" mentioned above.

SUMMARY OF THE INVENTION

This objective is accomplished by a weapon having a barrel or launch tube and a projectile preloaded therein, characterised by means for preventing accidental firing of the projectile if said weapon becomes overheated.

In a preferred embodiment said means for preventing accidental firing consist of means for deforming the inner area of the barrel or launch tube when a certain temperature is reached in the atmosphere around the weapon. Preferably, said means for preventing accidental firing include at least one element of SMA (Shape Memory Alloy). Said SMA element is advantageously a ring on the outer surface of the barrel or launch tube apt to reduce its dimension when reaching a certain temperature. In the preferred embodiment said ring consist of Nitinol.

For a weapon in which said projectile has a nose tapering in the firing direction of the barrel or launch tube, said ring on the outer surface of the barrel or launch tube is disposed in the region of said nose distal from its base, i.e. the portion of the nose having the largest cross-section.

In a second preferred embodiment a strip of SMA apt to reduce its dimension when reaching a certain temperature is provided in a circumferential groove in the inner wall of the barrel or launch tube, at least the ends of said strip are anchored to the barrel or launch tube. Advantageously, said strip is anchored to the barrel or launch tube also in an area opposite to the ends of said strip.

For a weapon in which said projectile has a nose tapering in the firing direction of the barrel or launch tube, said strip in the inner surface of the barrel or launch tube is disposed at the base of said nose, i.e. the portion of the nose having the largest cross-section.

In a third embodiment in a weapon in which said projectile has a nose tapering in the firing direction of the barrel or launch tube, a continuous or discontinuous groove in the inner surface of the barrel or launch tube disposed at the base of said nose, i.e. the portion of the nose having the largest cross-section, is filled with a material apt to enlarge its dimensions so that it protrudes inside of the inner surface of the barrel or launch tube when reaching a certain temperature.

BRIEF DESCRIPTION OF THE DRAWINGS

The invention will now be described with reference to the enclosed Figures, of which.

DESCRIPTION OF EMBODIMENTS

The Figures schematically disclose a pre-loaded light anti-amour weapon 1, such as AT4 WEAPON SYSTEM from SAAB Bofors Dynamics, Karlskoga, Sweden, provided with means 2 for preventing firing of the round 3 loaded therein, if the weapon is overheated, for example due to the weapon being subjected to the heat from a fire.

Figure 1:
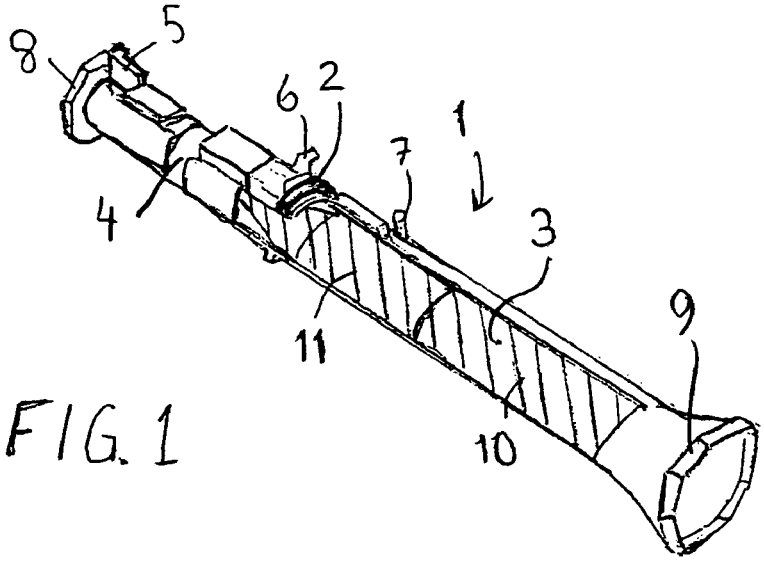
FIG. 1 discloses a schematic perspective view of a weapon according to a first embodiment of the invention with a portion of the barrel or launch tube removed, FIG. 2 discloses a schematic longitudinal cross-sectional view of the weapon in FIG. 1, FIG. 3 discloses a schematic cross-section of a portion of the a weapon according to a variant of the embodiment shown in FIGS. 1 and 2, and FIG. 4 discloses a schematic view of a portion of a weapon in a longitudinal cross-section according to a second embodiment thereof.

Weapon 1 consists mainly of a barrel or launch tube 4, in which a projectile or round 3 is pre-loaded. The barrel or launch tube is to be discarded after firing of the round 3. In FIG. 1, a portion of the barrel or launch tube is taken away in order to show the round 3 inside the barrel or launch tube, said round 3 being indicated by section lines. A front and rear sight 5,6, a firing mechanism 7 and front and rear shock absorbers 8 and 9, respectively are also present on the barrel or launch tube 4 and are very schematically shown in FIG. 1 but omitted in FIGS. 2-4 for the sake of clarity.

The round 3 consist of a cartridge case assembly 10 and a shell 11. A forward nose portion 12 of the shell 11 is tapering. Within the cartridge case is housed a propellant and an igniter composition for igniting the propellant. A detailed description of the components of weapon 1 and their function is not essential to the understanding of the present invention and will therefore be omitted.

According to the present invention weapon 1 is provided with means for preventing firing of the round 3 loaded therein, if the weapon is overheated, for example due to the weapon being subjected to the heat from a fire. These means consist in preferred embodiments of means for deforming the inner surface of the barrel or launch tube 4 so that the round 3 is unable to leave the barrel or launch tube even if the propellant in the cartridge 10 case is accidentally ignited due to overheating of the weapon 1.

In the first embodiment the means for deforming the inner surface of the barrel or launch tube consist of a ring 2 of Shape Memory Alloy (SMA) surrounding the outer periphery of the barrel or launch tube 4. When this ring 2 reaches a certain temperature which should be lower than the temperature at which the propellant self-ignites, it will in a few seconds reduce its diameter and thereby also the diameter of the barrel or launch tube. For the above mentioned weapon AT4 WEAPON SYSTEM the temperature at which the dimensional change of the ring 2 shall occur is about 100° C.

A suitable SMA for a temperature of about 100° C. is for example Nitinol, an alloy of approximately equal parts of Ni and Ti. The ring 2 is manufactured by several operations of drawing and heating a strip of SMA until the desired contractile property of the strip is obtained. The strip has in the disclosed embodiment a rectangular cross-section but other shapes, such as circular or square cross-section, could of course also be used. The strip of SMA is after the drawing and heat treatment bent to ring shape and the ends of the strip are affixed to each other, preferably by welding.

Figure 2:
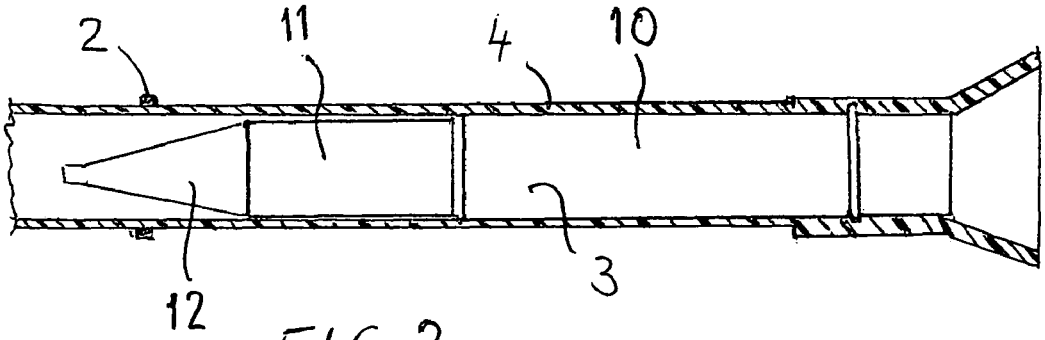

The aim of the ring 2 is to prevent the shell 11 from leaving the barrel or launch tube 4 if the propellant in the cartridge case 10 is accidentally ignitited due to the weapon 1 being surrounded by an overAT4 Weapon systemed atmosphere. The ring 2 must therefore be disposed on the barrel or launch tube 4 in front of the cartridge 10. Preferably, the ring 2 is disposed on the barrel or launch tube within the region thereof in which the shell 11 is housed. More preferably, the ring 2 is disposed within the region of the barrel or launch tube in which the nose 12 is housed. In such a case, the ring 2 can contract due to overheat and thereby deform the barrel or launch tube 4 without deformation of the shell 11. In FIG. 2, the ring is disposed about half way between the forward end of the nose 12 and the rear base end thereof. When the ring 2 contracts, the barrel or launch tube can follow the radial movement of the ring by bending around the interface between the base of the nose 12 and the cylindrical rear part of shell 11. Preferably, the axial disposition of the ring 2 is such that after contraction of the ring 2, the peripheral area of the barrel or launch tube 4 containing the ring 2 is in abutment with the outside of the tapering nose part 12 of the shell 11. In such a case the shell 11 is not only prevented from leaving the barrel or launch tube but also prevented from moving at all therein. However, such a placing of the ring 2 is not necessary, the contraction of the ring and local reducing of the diameter of the barrel or launch tube being a consequence thereof will be enough to prevent the shell from leaving the barrel or launch tube as long as the ring is disposed in front of the shell.

If the ring 2 is disposed in the region of the cylindrical part of the shell 11 it will also function to deform the barrel or launch tube 4. However, in such a case also the shell 11 will be deformed which is not preferred.

Figure 3:
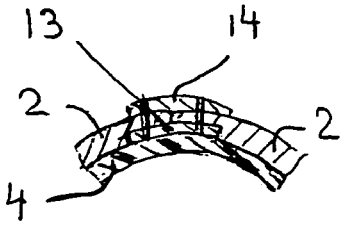

In FIG. 3, a variant of the embodiment shown in FIGS. 1 and 2 is disclosed. The only difference to the embodiment of FIGS. 1 and 2 is that the ends of the stripe of SMA forming the ring 2 is not welded together but mechanically joined to each other. In the variant shown in FIG. 3, the opposing ends of the ring 2 is held between two plates 13,14 and these plates are affixed to each other with the help of screws or the like passing through holes drilled in the ends of the ring 2. Instead of having two plates it is possible to only use one plate on the outside of the ring. It is also possible to totally delete the plates and anchor the opposing ends of the ring directly in the underlying part of the barrel or launch tube.

Figure 4:
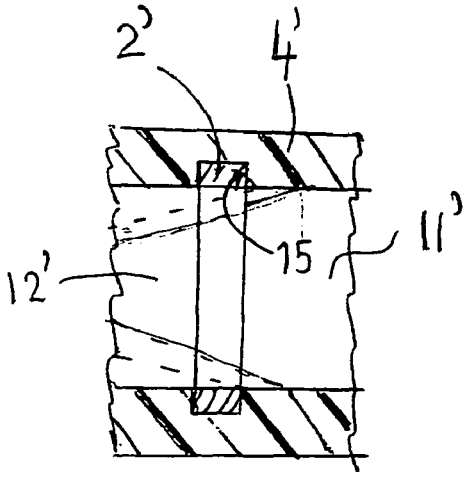

In FIG. 4, a second embodiment is schematically disclosed. This embodiment differs from the embodiment disclosed in FIGS. 1-2 in that the ring 2' is disposed inside the barrel or launch tube and not at the outside as in the first embodiment. In all other respects the embodiments are the same and components in the embodiment according to FIG. 4 similar to components in the embodiment according to Figures are given the same reference numbers with the addition of a prime sign. In the second embodiment as shown in FIG. 4, the ring 2' is disposed in a peripheral groove 15 made in the inner surface of the ring 2'. When overheated, the ring 2' will contract in the same way as the ring 2 in the first embodiment. If the contraction is so small that only a circumferential portion of the ring 2' will protrude outside the groove 15, the ring 2' need not be affixed to the barrel or launch tube 4'. However, it is preferred that at least the ends of the strip from which ring 2' is formed are anchored to barrel or launch tube 4', for example with the aid of screws or the like to ensure that the ring 2' will have at least one portion remaining in the groove 15 after the contraction thereof due to overheating. Preferably, the ring 2' is anchored to the barrel or launch tube 4' in two points opposing each other diametrically. In such a case, the ring will have an oval shape after contraction. Also in this embodiment the ring 2' is preferably disposed in the axial region of the barrel or launch tube housing the nose of the shell and more preferably in the vicinity of the base of the nose 12'.

In a third embodiment of the invention which is not shown in the Figures, a ring is also disposed in a groove in the inner part of the barrel or launch tube. In the third embodiment the ring is of a material with a higher thermal expansion coefficient than the material of the barrel or launch tube. The dimension of this ring is such that when the temperature reaches a certain temperature, for example 100° C., the inner surface of the ring is flush with inner surface of the barrel or launch tube. If the ring due to overheating reaches a higher temperature than the temperature in question, an inner portion of the ring will protrude out from the inner surface of the barrel or launch tube and thereby prevent the shell from passing out of the barrel or launch tube. Also in this case, the ring is preferably disposed at or in the vicinity of the base of the nose portion of the shell. If the temperature is lower than said certain temperature, for example 20° C., the inner surface of the ring will be disposed within the groove at a distance from the inner surface of the barrel or launch tube. In order to not cause radial loads on the barrel or launch tube due to thermal expansion of said ring, the ends of said ring can be distanced from each other. It is also possible to instead of a ring in a groove place ring segments or even pins or the like in indentations in the inner surface of the barrel or launch tube in a peripheral row therein. Such segments or pins can be glued to the barrel or launch tube within the indentations therein.

The embodiments can of course be modified within the scope of the invention. For example, other SMA:s than Nitinol, such as other alloys of Cu—Al, Cu—Al—Zn, Cu—Al—Ni or Cu—Ni—Al—Zn—Mn, can be used. Other weapons than AT4 WEAPON SYSTEM having pre-loaded barrel or launch tubes can be provided with means according to the present invention for preventing firing of the projectile loaded therein due to overAT4 Weapon system. More than one ring of SMA can be used instead of the only ring shown in the Figures. The invention shall therefore only be limited by the content of the enclosed patent claims.

The invention claimed is:

1. A weapon comprising:

a barrel or launch tube;

a projectile preloaded in the barrel or launch tube, the projectile comprising propellant and a shell; and at least one element configured to prevent accidental firing of the projectile if said weapon becomes overheated, wherein the at least one element configured to prevent accidental firing deforms an inner area of the barrel or launch tube when a certain elevated temperature lower than a temperature at which the propellant self-ignites is reached in the atmosphere around the weapon, thereby preventing the projectile from leaving the barrel or launch tube.

2. The weapon according to claim 1, wherein said at least one element configured to prevent accidental firing comprises at least one element of shape memory alloy.

3. The weapon according to claim 2, wherein said shape memory alloy element comprises a ring on the outer surface of the barrel or launch tube apt to reduce its dimension when reaching a certain temperature.

4. The weapon according to claim 3, wherein said ring comprises Nitinol.

5. The weapon according to claim 3, wherein said projectile comprises a nose tapering in a firing direction of the barrel or launch tube, and wherein said ring on the outer surface of the barrel or launch tube is disposed in a region of said nose distal from a base of the nose.

6. The weapon according to claim 2, wherein a strip of shape memory allow apt to reduce its dimension when reaching a certain temperature is provided in a circumferential groove in an inner wall of the barrel or launch tube, at least ends of said strip are anchored to the barrel or launch tube.

7. The weapon according to claim 6, wherein said strip is anchored to the barrel or launch tube also in an area opposite to the ends of said strip.

8. The weapon according to claim 6, wherein said projectile comprises a nose tapering in a firing direction of the barrel or launch tube, said strip in the inner surface of the barrel or launch tube being disposed at a base of said nose.

9. The weapon according to claim 2, wherein said projectile has a nose tapering in a firing direction of the barrel or launch tube, wherein a continuous or discontinuous groove in an inner surface of the barrel or launch tube is arranged in the barrel or launch tube at a base of said nose, and wherein the groove is filled with a material apt to enlarge dimensions of the material so that the material protrudes inside of the inner surface of the barrel or launch tube when the material reaches the certain elevated temperature.

10. The weapon according to claim 3, wherein said projectile comprises a nose tapering in a firing direction of the barrel or launch tube, and wherein said ring on the outer surface of the barrel or launch tube is disposed in a region of said nose having a largest cross-section.

11. The weapon according to claim 6, wherein said projectile comprises a nose tapering in a firing direction of the barrel or launch tube, said strip in the inner surface of the barrel or launch tube being disposed at a portion of the nose having a largest cross-section.

12. The weapon according to claim 2, wherein said projectile has a nose tapering in a firing direction of the barrel or launch tube, wherein a continuous or discontinuous groove is arrange in the barrel or launch tube in the vicinity of a portion of the nose having the largest cross-section, and wherein the groove is filled with a material apt to enlarge dimensions of the material so that the material protrudes inside of the inner surface of the barrel or launch tube when the material reaches the certain elevated temperature.

* * * * *